US009481996B2

(12) United States Patent
Duforestel et al.

(10) Patent No.: US 9,481,996 B2
(45) Date of Patent: Nov. 1, 2016

(54) THERMAL INSULATING PANEL

(71) Applicant: ELECTRICITE DE FRANCE, Paris (FR)

(72) Inventors: Thierry Duforestel, Moret sur Loing (FR); Diane De Cacqueray, Paris (FR); Pierre-Henri Milleville, Vernou la Celle sur Seine (FR)

(73) Assignee: ELECTRICITE DE FRANCE, Paris (FR)

( * ) Notice: Subject to any disclaimer, the term of this patent is extended or adjusted under 35 U.S.C. 154(b) by 0 days.

(21) Appl. No.: 14/407,437

(22) PCT Filed: Jun. 11, 2013

(86) PCT No.: PCT/EP2013/062054
§ 371 (c)(1),
(2) Date: Dec. 11, 2014

(87) PCT Pub. No.: WO2013/186225
PCT Pub. Date: Dec. 19, 2013

(65) Prior Publication Data

US 2015/0152635 A1 Jun. 4, 2015

(30) Foreign Application Priority Data

Jun. 12, 2012 (FR) ..... 12 55497

(51) Int. Cl.

| | |
|---|---|
| ***F16L 59/065*** | (2006.01) |
| ***E04B 1/76*** | (2006.01) |
| ***E04B 1/74*** | (2006.01) |
| ***E04B 1/80*** | (2006.01) |
| ***E04C 2/34*** | (2006.01) |
| ***E04B 2/00*** | (2006.01) |
| *F28F 13/00* | (2006.01) |

(52) U.S. Cl.
CPC ..... *E04B 1/7612* (2013.01); *E04B 1/74* (2013.01); *E04B 1/76* (2013.01); *E04B 1/80* (2013.01); *E04C 2/3405* (2013.01); *E04C 2/44* (2013.01); *E04B 1/803* (2013.01); *E04B 1/806* (2013.01); *F28F 2013/008* (2013.01)

(58) Field of Classification Search
CPC ... Y10T 428/231; F16L 59/065; E04B 1/803
USPC ..... 428/69
See application file for complete search history.

(56) References Cited

U.S. PATENT DOCUMENTS 5,014,481 A 5/1991 Moe
2009/0308975 A1 12/2009 Macgregor et al.

FOREIGN PATENT DOCUMENTS

WO WO 03/054456 A1 7/2003

*Primary Examiner* — Alexander Thomas
(74) *Attorney, Agent, or Firm* — Blakely Sokoloff Taylor & Zafman LLP

(57) ABSTRACT

The invention relates to a thermal insulation device comprising at least one panel (100) provided with two walls (110, 120) separated by a peripheral main spacer (102) in order to define a gas-tight chamber (104) containing a partial vacuum, and at least two flexible films (150, 160) locally attached to secondary spacers (140) at intermediate points between the two walls (110, 120) and defining tight secondary compartments (158) between each other. As a result of applying successive potentials of selected polarity between the walls (110, 120) and the flexible films (150, 160), the flexible films (150, 160) are moved between a first thermal insulation position wherein the films (150, 160) are separated from each other and a second position wherein the films (150, 160) are in mutual contact at least on a substantial part of the surface thereof.

13 Claims, 6 Drawing Sheets

THERMAL INSULATING PANEL

Figure 1:
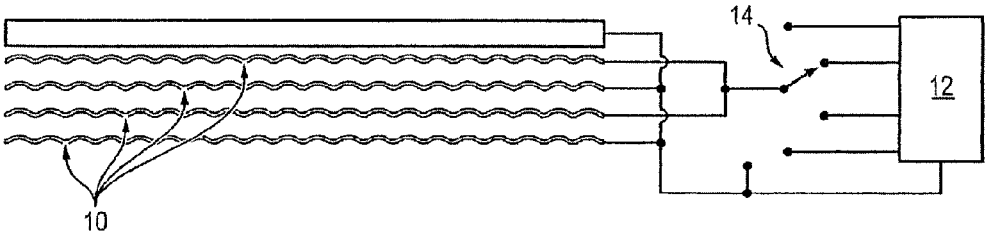
FIG. 1 Prior art

The present invention relates to the field of the thermal insulation of buildings.

More precisely, the present invention relates to the field of thermal insulation under air or gas vacuum.

For more than 20 years, the concept of insulating under vacuum has been studied for various applications, including insulation of buildings. But early industrial applications have essentially related to problems of cold (refrigerators, freezers, refrigerated containers, etc.). In fact, in terms of thermal insulation, on land, only the technique of vacuum insulation produces minimal thermal conductivities resulting in minimal insulating thicknesses for a given thermal resistance.

For applications of insulation to buildings, the theme of vacuum insulating really appeared in research and development laboratories only in the late 90s when energy and environmental policies promoted increased research in this sector on the topic of the energy efficiency.

The considerable weight of power consumption from existing buildings in industrialised countries impose effectively the radical reinforcement of thermal insulation of opaque walls of buildings. So the idea of using insulating of very low thermal conductivity (less than 10 mW/m.K), therefore very thin for any given thermal resistance, was imposed as evidence for limiting the impact of thermal losses of opaque walls on available living spaces.

There are concepts of insulating panels comprising core materials of low thermal heat conductivity, enclosed by an airtight envelope barrier and fully evacuated, which could be qualified as super insulators as compared to the performance of traditional insulators. Several families of products can be distinguished according to the nature of the envelope, that of the core material and the way in which the vacuum is managed over time.

For the envelope, two families can be distinguished: on the one hand the family of metallic envelopes where the tightness in fact comprises metallic plaques of steel or aluminium and, on the other hand the family constituted by all the other envelopes, the most frequent case being that of an envelope constituted by alternating plastic and metallic (or metallised) polymer layers.

For the core materials, the distinction essentially refers to the nature of the nanostructured porosity or not. On the functional plane, a nanostructured material is less sensitive than the others to a rise in pressure in the panel under vacuum. Because of this, the materials of this family conserve high thermal performance even if leaks (in practice inevitable) let gas into the component when it is operating.

As for managing the vacuum, two families are distinguished here. For the first, the must current, the vacuum is obtained at the fabrication of the component and then the core material and the tightness of the envelope are relied on to keep them at a sufficient level so that the component continues to ensure its insulation function sustainably. Durable means the shelf life relative to the envelope of the building, that is, of the order of 10 to 40 years. Within this family the distinction can also be made between those products for which the core material receives the aid of a "getter" (a capsule of molecular screen which captures gas in the component to maintain a high vacuum until its saturation prevents it from continuing to ensure this function) and those which do not have it. The second family is that of vacuum insulators whereof the vacuum is maintained permanently by a vacuum pump connected to the component.

Problems raised by known products of this type, for use in insulation of the building, are many.

Three problems of different kinds will be mentioned here.

The first relates to the insulating component moving to the insulated wall. Effectively, evacuating porous material and enclosing it in an airtight envelope makes it possible to build a highly insulating component, whereof the thermal conductivity can remain less than 10 mW/m.K permanently. But this performance is that of the current part or body of the component. The sealing barrier which encloses the core material is always metallic or metallised. It therefore causes a consequent thermal bridge (by conduction of heat) on the edges of the component. So, if several components are assembled side by side to make an insulating wall, the level of insulation of the assembly, given these thermal bridges, is much less than that of the current part. Clearly, this means can be used to manufacture super insulators, but it is more difficult to make super insulators with these super insulators. One solution could be to make large-size components to limit the impact of edges, but then fabrication, and especially operations for evacuation and closing the envelope, become very long, very complex and very costly.

The second problem comes from the presence of the core material. So, even if a perfect vacuum were set up in the component, it would remain a mode of transfer by conduction through the solid nanostructured matrix of the core material. This inevitable phenomenon with this type of component inevitably restricts thermal conductivity it can achieve at a minimal value of the order of 5 mw/m.K.

The latter problem is that such a component can behave only as a thermal insulator. Even in the case of a maintained vacuum, where it seems possible to act on the vacuum level to control the thermal conductivity of the component, only a highly restricted range of conductivity can be acted on, in practice at best between 5 mW/m.K when it is under vacuum and less than 30 mW/m.K when it is at atmospheric pressure. This range is not enough to regulate the envelope continuously such that it insulates considerably when there is a need to conserve heat or cold inside the building and such that it insulates practically no more when by comparison the aim would be to have heat or external cold enter the building.

Examples of known devices of thermal insulation are found in documents U.S. Pat. Nos. 3,968,831, 3,167,159, DE-A-19647567, U.S. Pat. No. 5,433,056, DE-A-1409994, U.S. Pat. No. 3,920,953, SU-A-2671441, U.S. Pat. Nos. 5,014,481, 3,463,224, DE-A-4300839.

Another avenue of investigation for making a device of controlled thermal insulation, that is, designed to modify thermal conductivity on command, is proposed in documents U.S. Pat. No. 3,734,172 and WO-A-03/054456.

Document U.S. Pat. No. 3,734,172, published in 1973, proposes a device comprising a stack of supple sheets 10 whereof the distance is supposed to be modified by electrostatic forces, during application of controlled electric voltages between these sheets, by means of a generator 12 and an associated switch 14.

In practice, such a device has not undergone consequent industrial development, absent a good outcome.

Figure 2A:
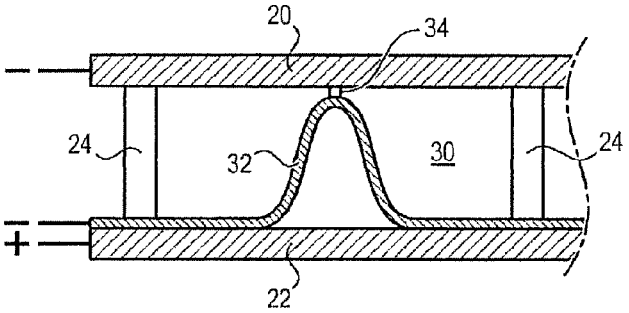
FIG. 2a Prior art
Figure 2B:
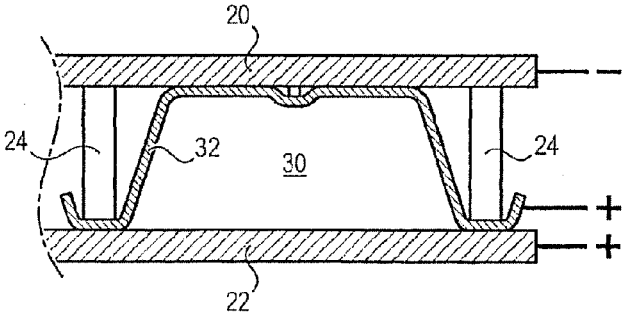
FIG. 2b Prior art

Document WO-A-03/054456 has tried to improve on the situation by proposing a device of the type illustrated in FIG. 2, comprising a panel defined by two partitions 20, 22 separated by spacers 24 and delimiting a chamber 30 placed at ambient pressure or in depression and which houses a deformable membrane 32. The membrane 32 is connected occasionally to a first partition 20 at a thermally insulating point 34. It is also clamped between the spacers 24 and the second partition 22. As is seen in FIG. 2*a*, when opposite polarity potentials are applied to the membrane 32 and the second partition 22 while potentials of same polarity are applied to the first partition 20 and the membrane 32, the latter is pressed against the second partition 22. Inversely, as is seen in FIG. 2*b*, when opposite polarity potentials are applied to the membrane 32 and the first partition 20 while potentials of same polarity are applied to the second partition 22 and to the membrane 32, the latter is pressed against the first partition 20. It is understood that the resulting switching of state of the membrane 32 modifies on command the thermal conductibility between the two partitions 20 and 22.

Faced with the difficulties encountered during tests on the device illustrated in FIG. 2, document WO-A-03/054456 itself proposes an evolution of this device, illustrated in FIG. 3, which comprises a V-shaped deflector 40 at the base of the spacers 24, on the side of the second partition 22, and U-shaped cradles 42 on the first partition 20.

Such attempts at evolution have not however enabled real industrial development on this device.

The dislike by manufacturers for this product, despite strong existing demand in the field of thermal insulation for buildings, largely comes from the complexity of the product, gleaned from simple visual examination of FIG. 3.

In this context, the aim of the present invention now is to propose a novel thermal insulation device which has qualities greater than the state of the art in terms of cost, industrialisation, efficacy and reliability, especially.

More precisely the aim of the present invention is to propose novel means for producing a device of thermal insulation likely to evolve between a state of strong thermal insulation and a state of lesser thermal insulation, or even relative thermal conduction.

This aim is attained within the scope of the present invention by a device of thermal insulation, especially for buildings, characterized in that it comprises at least one panel comprising two walls separated by a principal peripheral spacer to define a gastight chamber, in depression, and at least two supple films arranged in said chamber, fixed locally to secondary spacers, at intermediate points between the two walls and together defining airtight secondary compartments, such that, by application of successive potentials of polarity selected between the walls and the supple films, the supple films are moved between a first position of thermal insulation in which the films placed at the same electrical potential of polarity opposite the electrical potential of the walls, are separated from each other and in contact with the walls, the pressure in the secondary compartments defined between the films being less than the pressure prevailing in the chamber outside the compartments and a second position in which the films are separated from the walls and in mutual contact at least over a substantial part of their surface, said second position having properties of thermal insulation less than the first position.

Figure 3A:
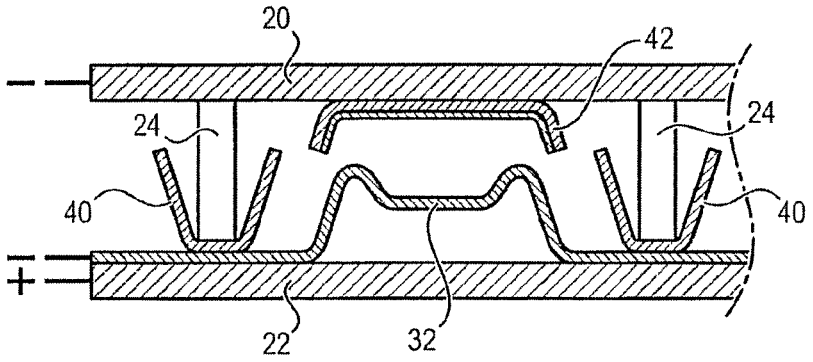
FIG. 3a Prior art
Figure 3B:
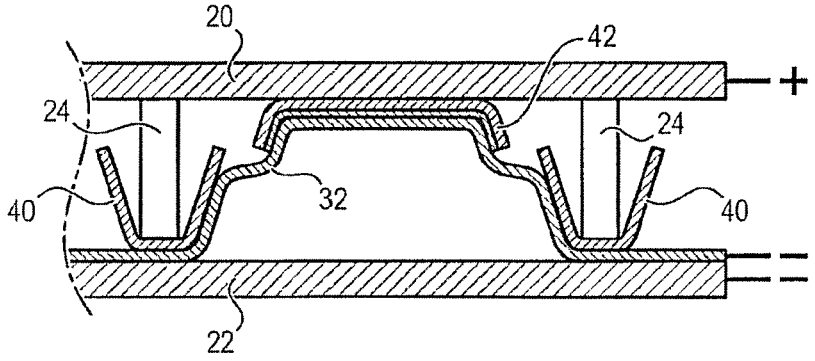
FIG. 3b Prior art
Figure 6:
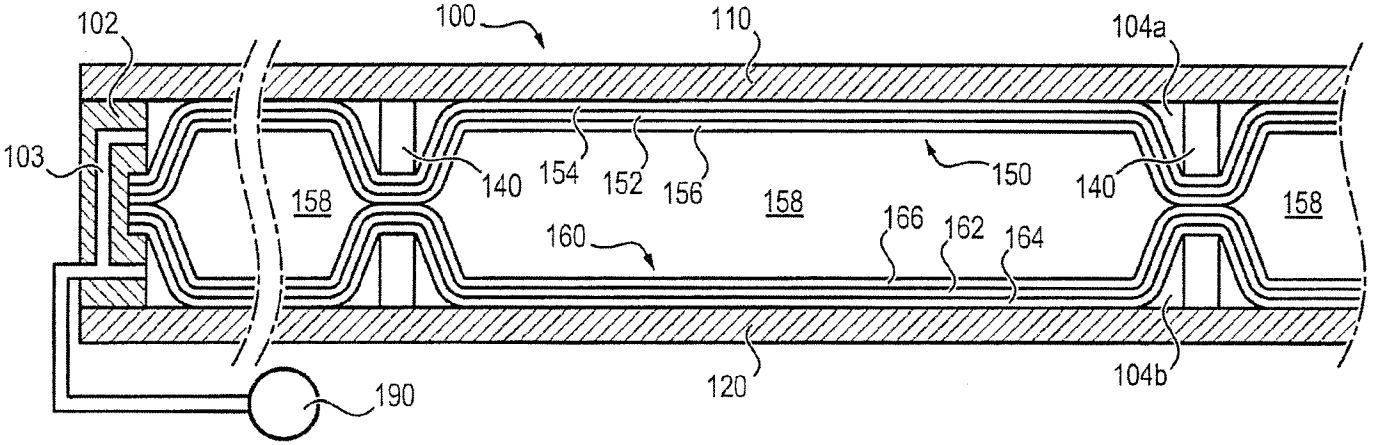
Figure 7:
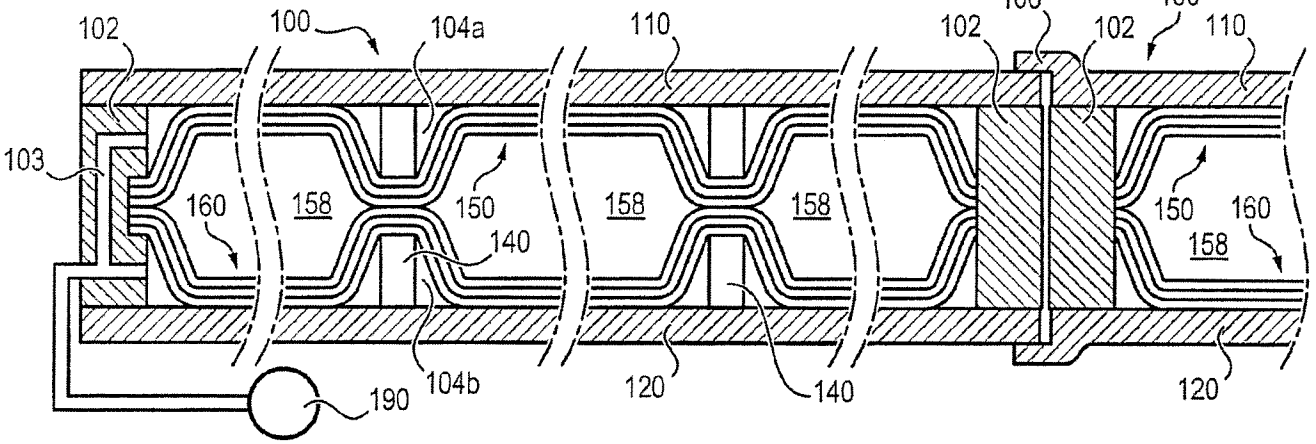
Figure 8:
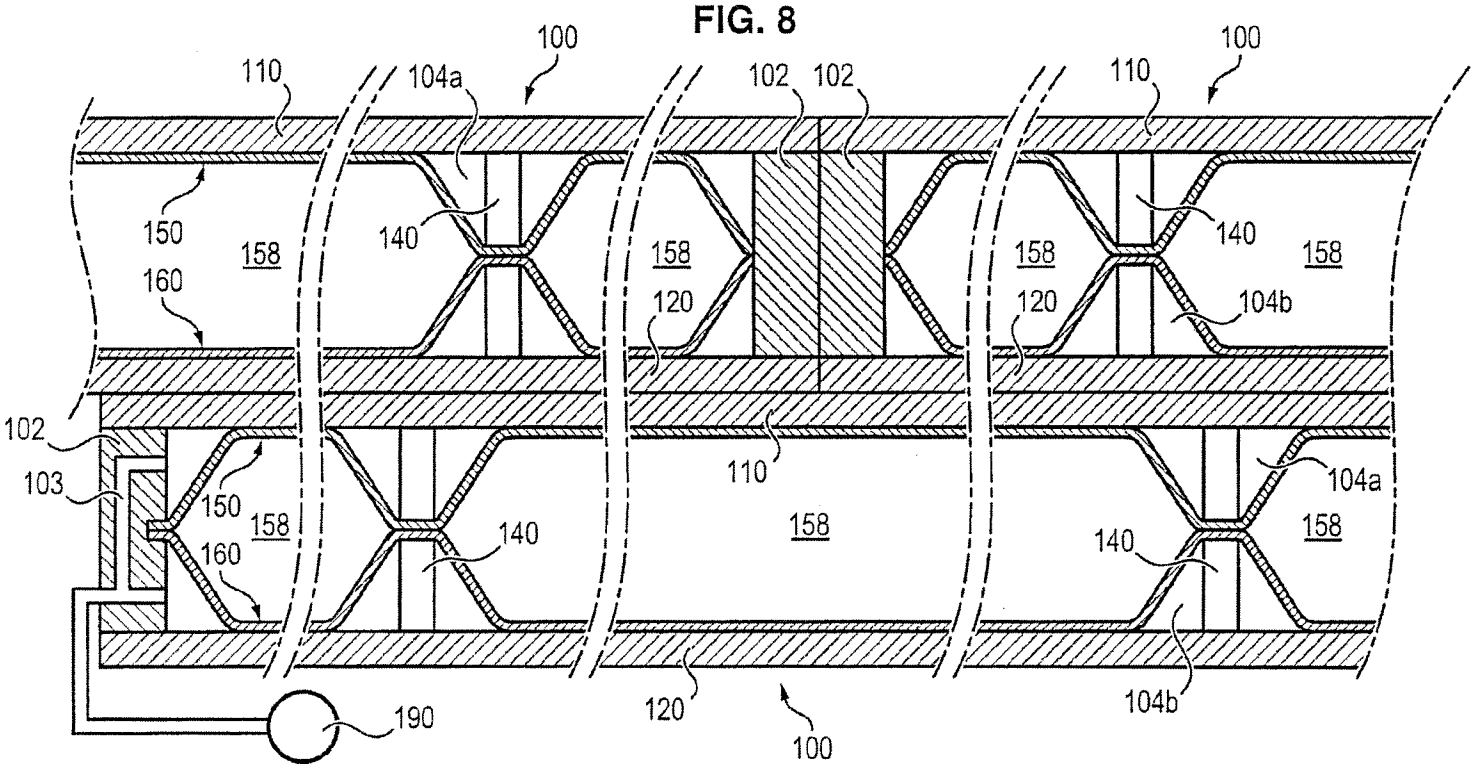
Figure 9:
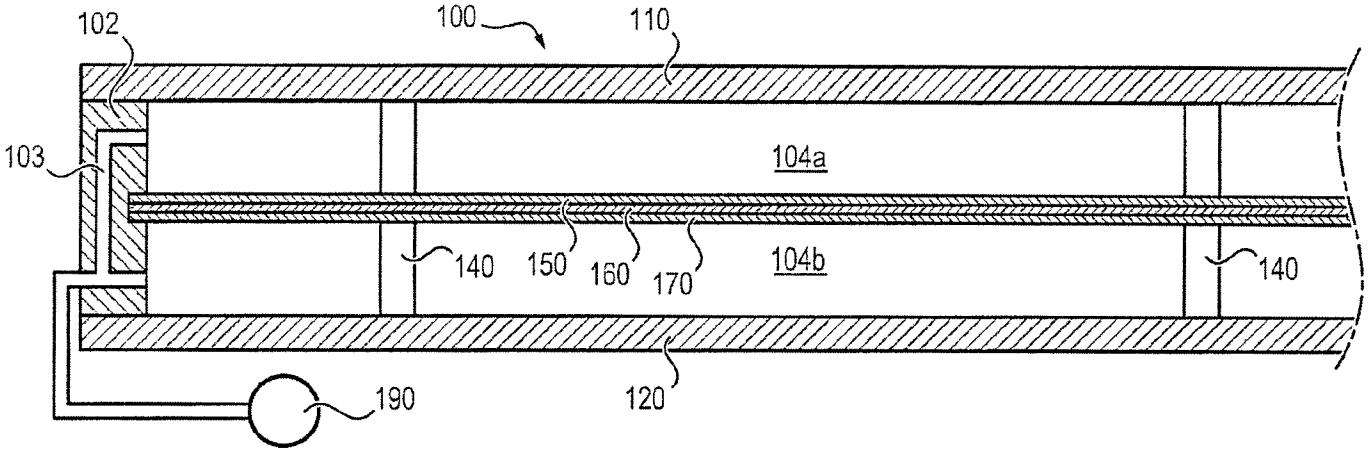
Figure 10:
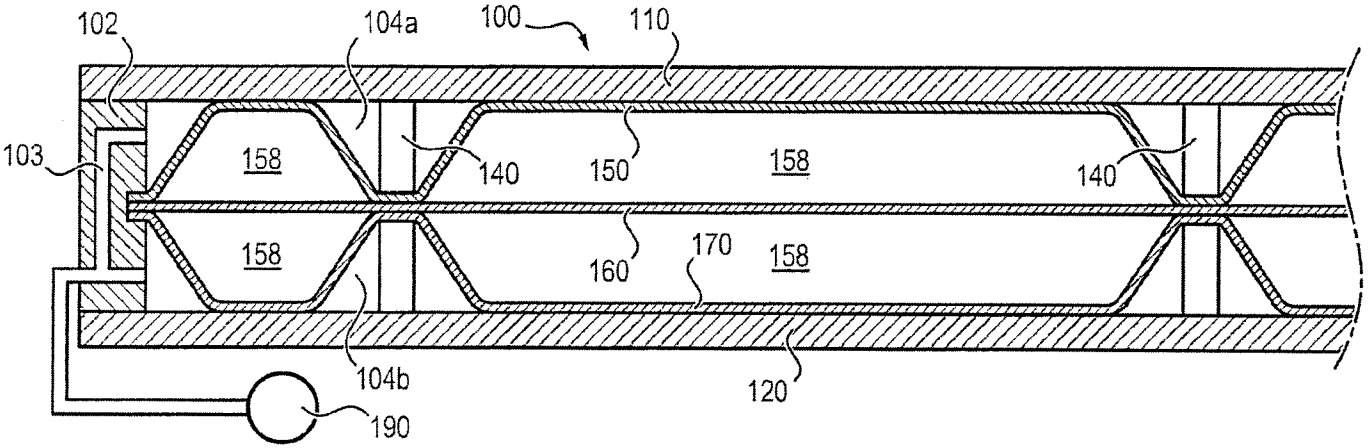

Other characteristics, aims and advantages of the present invention will emerge from the following detailed description, and with respect to the appended drawings, given by way of non-limiting examples and in which:

FIG. 1, previously described, schematically illustrates a device of thermal insulation according to the idea of document U.S. Pat. No. 3,734,172, FIGS. 2*a* and 2*b* illustrate two states of a device according to a first variant of a device according to document WO-A-03/054456, previously described, FIGS. 3*a* and 3*b* schematically illustrate two similar states of a device previously described, according to a second variant embodiment espoused by document WO-A-03/054456, FIGS. 4 and 5, attached, illustrate, according to schematic views in transversal section, two states of a basic device of thermal insulation according to the present invention, FIG. 6 illustrates a view of an improved device according to the present invention, FIG. 7 illustrates the assembly of several elementary panels according to the present invention, edge against edge, FIG. 8 illustrates the superposition of several panels of a device of thermal insulation according to the present invention, and FIGS. 9 and 10 illustrate two states of a device of thermal insulation according to a variant embodiment of the present invention.

Figure 4:
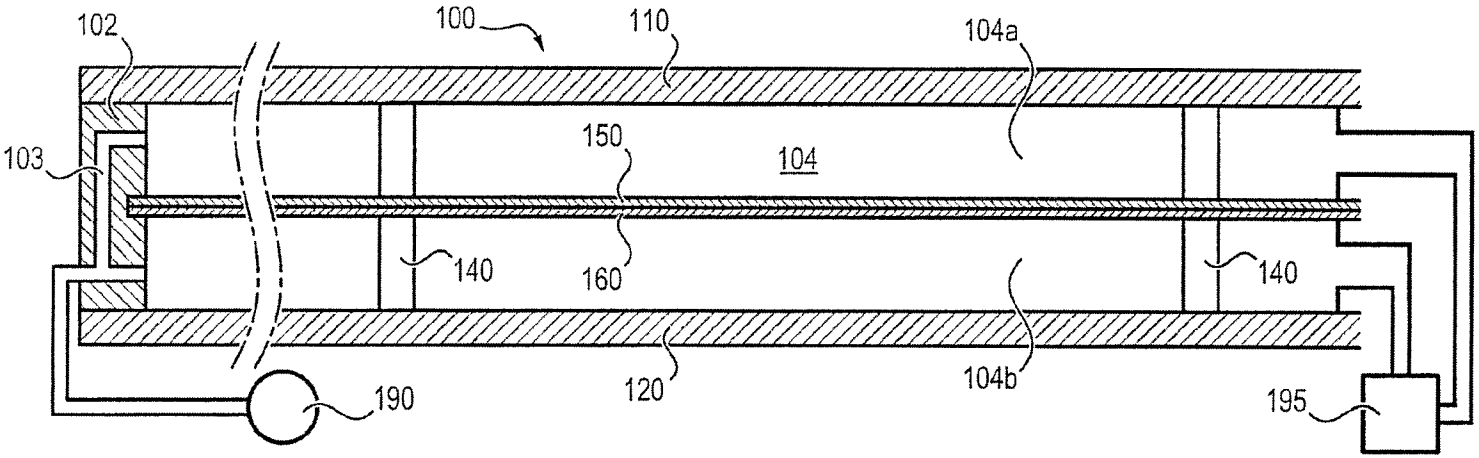

FIG. 4 and the following attached figures show a thermal insulation panel 100 according to the present invention comprising two principal walls 110, 120, separated by a principal peripheral spacer 102 to form a gastight chamber 104. The chamber 104 is placed in depression, that is, at a pressure less than atmospheric pressure. Typically, the internal pressure of the chamber 104 is of the order of a few Pascals, advantageously between 1 Pa and 1000 Pa, very advantageously of the order of 10 Pa.

The chamber 104 houses at least two films 150, 160. The films 150, 160, are supple. They extend parallel to the walls 110, 120. The supple films 150, 160 are fixed locally onto secondary spacers 140, positioned between the walls 110, 120, at intermediate points between the two walls 110, 120.

More precisely, he films 150, 160 are preferably fixed on the spacers 140 at mid-distance between the two walls 110, 120. The supple films 150, 160 are susceptible to deformation, as will be explained later, in their portions which extend between two adjacent spacers 140.

The films 150, 160 define between them gastight compartments 158 placed below a controlled vacuum level.

Because the films 150, 160 are placed at mid-distance walls 110, 120, they divide the chamber 104 into two sub-chambers 104*a* and 104*b* located respectively on either side of the compartments 158.

Means of communication 103 are preferable provided to ensure a fluid connection between the two sub-chambers 104*a* and 104*b*. These means of communication 103 are also preferably adapted to ensure a fluid connection between pressure control means 190, such as a compressor or equivalent means, and said chamber 104.

Of course the spacers 102 and 140 are made of thermally insulating material so as not to constitute a thermal conduction bridge between the walls 110 and 120. In this way, the spacers 102, 140 are formed advantageously from thermoplastic material.

Figure 5:
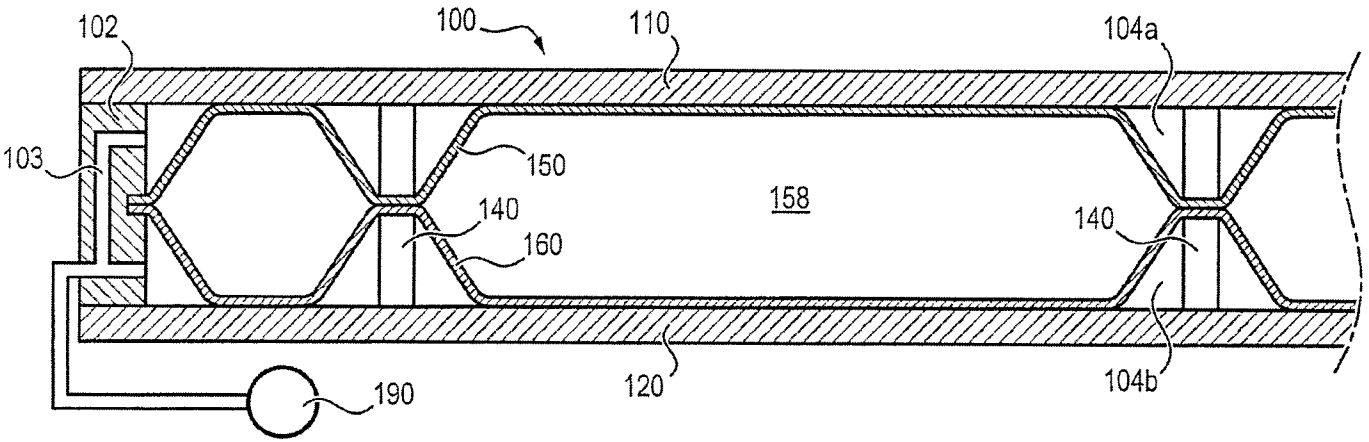

The operation of the device according to the present invention shown in FIGS. 4 and 5 is essentially the following.

Reference numeral 195 in FIG. 4 shows a generator adapted to apply potentials of controlled polarity respectively on the films 150, 160 and on the walls 110, 120.

During application of potentials of opposite polarities between the films 150, 160, on the one hand, and respectively identical polarities between each of the films 150, 160, and the wall 110, 120, opposite, the two films 150, 160 are pressed against each other at mid-thickness of the chamber 104, as illustrated in FIG. 4. They are placed in mutual contact at least over a substantial part of their surface, at a distance from the walls, that is, separated from the walls 110, 120. In this state, the films 150, 160, in mutual contact, enable some thermal transfer by reciprocal conduction.

In terms of the present invention, "substantial part" means a substantially major part of the surface of the films 150, 160, typically greater than at least 90% of this surface, the residue of the films 150, 160 which are not in mutual contact being due to the presence of a residue of gas molecules at very low pressure remaining present in the compartments 158.

On the contrary, when potentials of the same polarity are applied between the films 150, 160, on the one hand, and on the other hand, potentials of opposite polarities are applied respectively between each of the films 150, 160, and the wall 110, 120 placed opposite, as in FIG. 5, the films 150, 160 are respectively in contact with one of the walls 110, 120. As a consequence the films 150, 160 are separated from each other over their entire surface, with the sole exception of the common clamping zone at the level of the spacers 140. The films 150, 160 are separated by a layer of air at very low pressure, and are placed in a position of thermal insulation.

In this state the pressure in the compartments 158 between the films 150, 160 is less than the pressure which prevails in the sub-chambers 104*a* and 104*b* located on the exterior of the films 150, 160, preferably less than 1 Pa, or typically between $10^{-3}$ and $10^{-4}$ Pascals.

The tensions applied on the device respond to the Relationship $V/e=3{,}4.10^5(p/\epsilon_r)^{1/2}$, relationship in which:

V designates the electrical potential, e designates the initial distance between the external faces of the deformable supple films 150, 160, and the opposite surface of the plaques 110, 120, p represents the internal pressure in the chamber 104, and $\epsilon_r$ represents the permittivity of the medium filling the chamber 104.

The walls 110, 120, comprising the panel 100 can be the object of many variant embodiments.

The walls 110, 120, can be rigid. As a variant, they can be supple. In this case, the panel 100 can be rolled up, making it easier to transport and store.

The walls 110, 120 can be at least partially electrically conductive to enable application of an electric field generating the electrostatic forces required for switching of states of films 150, 160.

The walls 110, 120 can be made of metal.

They can also be made of composite material, for example in the form of an electrically insulating layer associated with an electrically conductive layer (metal or material charged with electrically conductive particles).

Similarly, the supple films 150, 160 are at least partially electrically conductive to enable application of the electric field required by generation of the above electrostatic forces.

Typically, the supple films 150, 160 are formed from a supple sheet of metal or based on thermoplastic material or equivalent, charged with electrically conductive particles.

As is seen in FIG. 6, the supple films 150, 160 are preferably each formed from an electrically conductive core 152, 162 coated on each of its faces with a coating of electrically insulating material 154, 156, 164, 166 (for example thermoplastic material).

It is evident within the scope of the present invention that it is necessary to provide electrical insulation between the films 150, 160, on the one hand, and between each of the films 150, 160 and the walls 110, 120 on the other hand, to avoid a short-circuit between these elements during application of successive voltages between these elements.

The electrically insulating layers 154, 156 and 164, 166, illustrated in FIG. 6, fulfill this function of electrical insulation. This function can be assured as variant by similar means provided on the walls 110, 120, at least for the electrical insulation required between the walls 110, 120 and the supple films 150, 160.

FIG. 7 illustrates a modular arrangement of several panels 100 according to the present invention, juxtaposed side by side by their edge. As is evident in FIG. 7, to ensure perfect continuity of insulation, covering elements 106 integrated into the walls 110, 120 of a panel 100 and adapted to overlap the adjacent panel are preferably provided. As a variant, such covering elements 106 could be provided on elements connected at the level of the joining zones between two such adjacent panels 100.

FIG. 8 also illustrates a combination of several panels in keeping with the present invention and stacked to reinforce the thermal insulation.

Of course, the present invention is not limited to the particular embodiments which have been described, but extends to any variant according to its principles.

The device according to the present invention offers good thermal insulation due to the vacuum prevailing in the chamber 104 and the depression prevailing in the compartments 158 between the films 150 and 160, in a position separated by the latter.

Means 190 for maintaining the vacuum are provided preferably inside the chamber 104 (for example based on pumps put into service sequentially or automatically or even gas-absorbing products as indicated previously).

Relative to some devices known from the prior art, the use of two thermally insulating films 150, 160 reinforce the effect of thermal barrier, that is, it reduces thermal conductivity.

The device according to the present invention enables manufacture in the form of overall minimal thickness compatible with internal insulation. Typically, the device according to the present invention has a maximal thickness of a few millimeters.

Those skilled in the art will understand that the present invention helps develop a controllable insulation system under vacuum of very minimal thickness which consequently has substantial thermal performance.

Preferably, the films 150, 160 are selected from a low-emission material in the infrared or is even treated to be low-emission in the infrared. Therefore the films 150, 160 have a coefficient of emission (defined as being the ratio between the emission from said films and the emission from a dark body) less than 0.1 for wavelengths greater than 0.78 μm.

Controlling the electrical field applied between the films 150, 160, and between the films 150, 160 and the walls 110, 120, either keeps the films in mutual contact or at a very slight distance, as illustrated in FIG. 4, making the system relatively thermally conductive, or separates the films 150, 160 making the system thermally insulating, as illustrated in FIG. 5.

Via the state of thermal conduction the device according to the present invention for example retrieves the solar contributions of walls exposed in winter or cools walls in summer when the external freshness allows, by placing the device in the state illustrated in FIG. 4.

According to a variant, all the components of the device, that is, walls 110, 120 and films 150, 160 can be optically transparent in the visible field (0.4-0.8 μm). The device according to the present invention can be applied to transparent walls, for example in front of a solar sensor.

It is noted particular that all the devices in keeping with the prior art using core materials do not allow such a property of optical transparency.

The panels of thermal insulation according to the present invention can also play a decorative role.

If the device according to the present invention is applied to the wasteful walls of a building, insulation can be modulated to optimise the retrieval of external contributions (solar in winter, freshness in summer). Contrary to the current concept of heating or airconditioning, where internal installation regains heat losses or gains through the envelope, this is a system which manages this heat loss or gain to conserve the preferred conditions of inner comfort. Such control can of course be operated automatically from appropriate thermal probes.

The present invention also contributes to totally controlling the thermal inertia of walls of buildings in limits never attained to date.

Of course, the present invention is not limited to the previously mentioned particular application of insulation of buildings. The present invention which results in excellent electrical insulation independent of the thickness of the device and allowing extremely minimal thickness applies the present invention to a large number of technical fields.

The present invention can apply in particular to coatings or any other industrial problem requiring thermal insulation.

As indicated previously the present invention is not limited to the presence of two films 150, 160 inside the chamber 104. FIGS. 9 and 10 illustrate a variant embodiment according to which three adjacent films 150, 160 and 170 are provided at mid-distance between the walls 110, 120.

When the potentials applied between each pair of adjacent films 150, 160 and 170 are alternatively opposed and also the potentials applied to the outermost films 150, 170 are identical to the walls placed respectively opposite 110, 120, the films are in mutual contact over a substantial part of their surface, as illustrated in FIG. 9 and the device is in a state of relative thermal conduction.

But when the potentials applied to the films 150, 160 and 170 are identical and opposite the respectively opposite walls 110, 120, the films 150, 160 and 170 are separated from each other by an air gap. The external films 150, 170 are pressed against the walls 110, 120, in a position separated from the central film or films 160. The device is in a position of thermal insulation resulting from separation between the films.

The invention claimed is:

1. A device for thermal insulation comprising at least one panel (100) comprising two walls (110, 120) separated by a principal peripheral spacer (102) to define a gastight chamber (104), under vacuum, and at least two supple films (150, 160) arranged in said chamber (104), fixed locally to secondary spacers (140) at intermediate points between the two walls (110, 120) and together defining airtight secondary compartments (158), such that by application of successive potentials of polarity selected between the walls (110, 120) and the supple films (150, 160), the supple films (150, 160) are moved between a first position of thermal insulation in which the films (150, 160) placed at the same electrical potential of polarity opposite the electrical potential of the walls (110, 120), are separated from each other and in contact with the walls (110, 120), the pressure in the secondary compartments (158) defined between the films (150, 160) being less than the pressure prevailing in the chamber (104) outside the compartments (158), and a second position in which the films (150, 160) are separated from the walls (110, 120) and in mutual contact at least over a substantial part of their surface, said second position having properties of thermal insulation inferior to the first position.

2. The device according to claim 1, wherein in the second position, the pairs of adjacent films (150, 160) receive opposite potentials.

3. The device according to claim 1, comprising at least three supple films (150, 160, 170) in the airtight chamber (104).

4. The device according to claim 1, wherein the walls (110, 120) are supple.

5. The device according to claim 1, wherein the walls (110, 120) are selected in the following group: walls made of metal, walls made of composite material, walls made from an electrically insulating layer and an electrically conductive layer, walls based on metal or charged with electrically conductive particles, walls (110, 120) whereof the internal face is coated in electrically insulating material.

6. The device according to claim 1, wherein the supple films (150, 160) are selected from the following group: films made of metal, supple films made based on thermoplastic material charged with electrically conductive particles, supple films coated by an electrically insulating coating (154, 156, 164, 166).

7. The device according to claim 1, wherein the internal pressure of the chamber (104) is between 1 Pa and 1000 Pa.

8. The device according to claim 1, wherein the pressure between the two films (150, 160) is less than the pressure which prevails in the sub-chambers (104*a* and 104*b*) located on the exterior of the films (150, 160), and less than 1 Pa.

9. The device according to claim 1, wherein at least one of the walls (110, 120) and the films (150, 160) are made of low-emission material in the infrared or treated to be low emission in the infrared and having a coefficient of emission less than 0.1 in the infrared.

10. The device according to claim 1, wherein the walls (110, 120) and the supple films (150, 160) are optically transparent in the visible.

11. The device according to claim 1, wherein in the second position, the pairs of adjacent films (150, 160) receive opposite potentials, respectively identical to the walls.

12. The device according to claim 1, wherein the internal pressure of the chamber (103) is on the order of 10 Pa.

13. The device according to claim 1, wherein the pressure between the two films (150, 160) is less than the pressure which prevails in the sub-chambers (104*a* and 104*b*) located on the exterior of the films (150, 160), and less than $10^{-4}$ Pascals.

* * * * *